United States Patent [19]

Naya et al.

[11] Patent Number: 5,019,156

[45] Date of Patent: May 28, 1991

[54] SINTERED ELECTRIC CONTACT MATERIAL FOR VACUUM SWITCH TUBE AND PROCESS FOR MANUFACTURING THE SAME

[75] Inventors: Eizo Naya; Mitsuhiro Okumura, both of Hyogo, Japan

[73] Assignee: Mitsubishi Denki Kabushiki Kaisha, Tokyo, Japan

[21] Appl. No.: 524,418

[22] Filed: May 17, 1990

[30] Foreign Application Priority Data

Jun. 5, 1989 [JP] Japan ..... 1-142446

[51] Int. Cl.[5] ..... B22F 9/00

[52] U.S. Cl. ..... 75/245; 75/247; 419/23; 419/38; 419/48; 419/57; 419/58

[58] Field of Search ..... 75/245, 247; 419/23, 419/38, 48, 57, 58

[56] References Cited

U.S. PATENT DOCUMENTS 3,957,453 5/1976 Hässler et al. ..... 75/245

4,503,010 3/1985 Kippenberg et al. ..... 75/245

*Primary Examiner*—Stephen J. Lechert, Jr.

*Attorney, Agent, or Firm*—Bernard, Rothwell & Brown

[57] ABSTRACT

A sintered electric contact material for use in vacuum switch tubes comprises about 50 to 70% by volume of a Cr powder, about 0.1 to 1.15% by volume of a Ti powder, and the remainder of a Cu powder. The sintered material can be obtained advantageously by heating a mixture of the Cr powder, the Ti powder and the Cu powder in a non-oxidizing atmosphere under pressure, at a temperature below the melting point of Cu (the melting point is 1083° C. at normal pressure).

17 Claims, 11 Drawing Sheets

FIG. 1A
WEIGHING AND MIXING OF Cu POWDER, Cr POWDER AND Ti POWDER
FIG. 1B
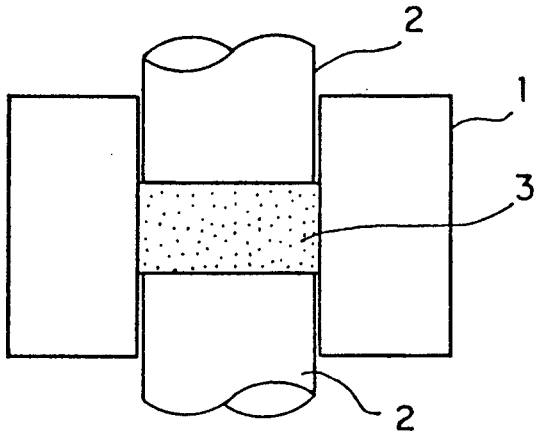
FIG. 1C
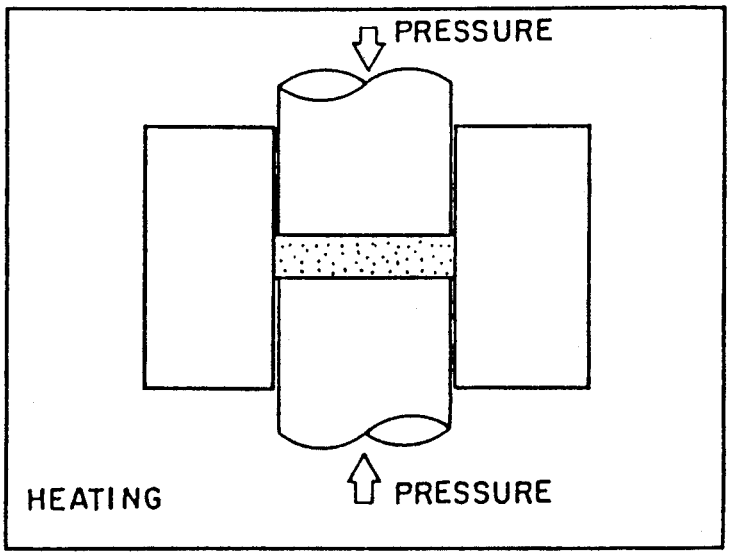

SINTERED ELECTRIC CONTACT MATERIAL FOR VACUUM SWITCH TUBE AND PROCESS FOR MANUFACTURING THE SAME

BACKGROUND OF THE INVENTION (1) Field of the Invention

This invention relates to a sintered electric contact material for vacuum switch tubes which maintains excellent withstand voltage performance even after a large number of load switching operations and has excellent circuit breaking performance, and to a process for manufacturing the same.

(2) Description of the Prior Art

Characteristic requirements of an electric contact material for use in vacuum switch tubes can be enumerated as excellent circuit breaking (current cutoff) performance, excellent withstand voltage performance, small chopping current, low material consumption, small tripping force against welding, low material transfer, etc., and there is a demand for a contact material which fulfills all these requirements. On the other hand, there are many cases in which the vacuum switch tube is exclusively used for an extremely large number of make-break cycles, for current closing or for current cutoff.

The conventional contact materials, in general, have a well-balanced combination of performances, but yet do not meet all the performance requirements. Therefore, the conventional contact materials are not satisfactorily suitable for use where a large number of current cutoff operations are to be performed or current closing operations. For instance, a Cu-W contact material has often been used in vacuum switch tubes for a current cutoff switch because of its excellent withstand voltage performance, but the withstand voltage performance is gradually lowered when the switch is frequently used for current closing operations. In addition, the Cu-W contact material is essentially low in breaking performance.

Thus, while the conventional contact materials for vacuum switch tubes have an overall well-balanced combination of performances, when applied to a use in which a specified kind of performance is of particular importance, the contact materials may fail to fulfill the requirement as to the performance characteristic. Accordingly, there is a demand for development of a new contact material.

SUMMARY OF THE INVENTION

This invention provides a solution to the above-mentioned requirements. It is accordingly an object of this invention to provide a contact material for vacuum switch tubes which maintains an excellent withstand voltage characteristic even after a large number of load connecting and disconnecting operations.

It is another object of this invention to provide a contact material for vacuum switch tubes which has excellent circuit breaking characteristics.

It is a further object of this invention to provide a contact material for vacuum switch tubes which shows only slight surface roughening, that is, little transfer of material, after a large number of load connecting and disconnecting operations.

It is yet another object of this invention to provide a process for manufacturing the above-mentioned novel contact material for vacuum switch tubes.

In one preferred embodiment, the contact material for vacuum switch tubes according to this invention comprises about 50 to 70% by volume of chromium, about 0.1 to 1.15% by volume of titanium, and the balance of copper.

The contact material for vacuum switch tubes can be manufactured by a process in which a mixture containing powdery chromium, titanium and copper in a predetermined ratio is pressed with heating at a temperature below the melting point of copper in a non-oxidizing atmosphere.

The features and advantages of this invention will become apparent from the following detailed description, referring to the accompanying drawings.

BRIEF DESCRIPTION OF THE DRAWINGS

FIGS. 1A–1C illustrate the steps for manufacturing a contact material according to one embodiment of this invention;

DETAILED DESCRIPTION OF THE PREFERRED EMBODIMENTS

Figure 2A:
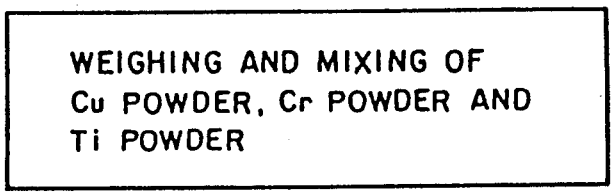
FIGS. 2A–2E illustrate the steps for manufacturing the contact material according to another embodiment of this invention.
Figure 2B:
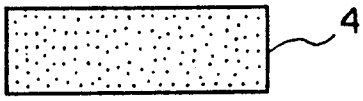

In one embodiment of this invention illustrated in FIGS. 1A–1C, a contact material for vacuum switch tubes is manufactured through a step of mixing a Cu powder, a Cr powder and a Ti powder in a predetermined ratio (FIG. 1A), a step of loading the thus obtained mixed powder 3 in a space formed by a die 1, which preferably comprises carbon, and a pair of punches 2 (FIG. 1B), and a step of pressing the mixed powder 3 in this condition between the pair of punches 2 with heating at a temperature below the melting point of copper (FIG. 1C). This process will be hereinafter referred to as "the hot pressing process".

The Cu powder mentioned above is preferably of at least 99% purity with a particle diameter of 100 μm or below. The Cr powder is preferably of at least 99% purity with a particle diameter of 100 μm or below. The Ti powder is preferably of at least 99% purity with a particle diameter of 100 μm or below. The Cu, Cr and Ti powders are mixed in such a ratio that the resultant mixed powder contains 50 to 70% by volume of the Cr powder, 0.1 to 1.15% by volume of the Ti powder and the remainder by volume of the Cu powder. The purities, particle diameters and mixing ratio of the Cu, Cr and Ti powders are set as mentioned above in order to obtain a contact material which fulfills the electrical characteristic requirements thereof.

The mixing of the Cu, Cr and Ti powders may be carried out by the usual methods For instance, mixing by a ball mill may be adopted.

The above-mentioned non-oxidizing atmosphere is used for preventing oxidation of the Cu, Cr and Ti powders and for accelerating sintering. The non-oxidizing atmosphere may be, for instance, a hydrogen or other reducing atmosphere, an Ar, $N_2$ or other inert gas atmosphere, or a vacuum of about $10^{-3}$ to $10^{-5}$ Torr. Among these atmospheres, preferred are hydrogen atmospheres and vacuum, from the viewpoint of a reducing action on the surfaces of Cu particles.

The heating temperature is below the melting point of Cu (1083° C.), preferably 980° C. or below, in order to restrain, as much as possible, the reaction between Cu and Cr and to prevent the lowering in electric conductivity. If the temperature is too low, however, there would arise the need for a greater pressing force at the time of pressing the mixed powder or the need for a very long time to complete the pressing. Thus, the heating temperature is preferably not lower than 800° C., on a practical basis.

Though the method for the above-mentioned pressing is not particularly limited thereto, the load used in the pressing should be 200 kg/cm$^2$ or above, in order to obtain a reduced porosity and to accelerate sintering. The greater the load, the shorter the time required for manufacturing the contact material. However, application of a higher load is accompanied by drawbacks in other aspects, such as a larger mechanism for generating the pressure for pressing, a larger die and, hence, a higher equipment cost. Thus, the load is preferably 500 kg/cm$^2$ or below. The pressing time may be determined, taking the load into account, within the range of about 0.5 to 3 hours so as to increase the density of the mixed powder to at least 99%.

The material for the die may be alumina, carbon and the like, among which carbon is preferred in view of the reducing action and good workability thereof.

The above-mentioned mixed powder may be molded into a compact by the usual molding techniques and the compact packed into the die. The method of preparing the compact has the advantage of increasing the packing quantity in the die by an amount corresponding to the reduction in the volume of the material to be packed, as compared with the method of packing the mixed powder directly into the die, and ensures a remarkably enhanced productivity.

In another embodiment of this invention, as illustrated in FIGS. 2A–2E, the Cu, Cr and Ti powders are mixed to produce a compact as mentioned above, then the compact is sealed in a can with a non-oxidizing internal atmosphere, and the pressure of the external atmosphere for the can is increased at a temperature below the melting point of Cu (the Hot Isostatic Press process will be hereinafter referred to as "the HIP process").

The powders and constituents to be used in the HIP process are the same as those in the above-mentioned first embodiment, and the compact is required only to be consolidated to such an extent that the compact can be dealt with by hand in the conventional manner.

Figure 2C:
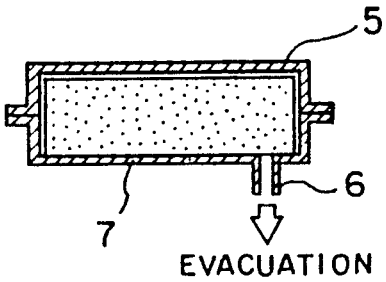
Figure 2D:
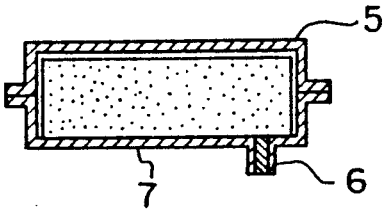
Figure 2E:
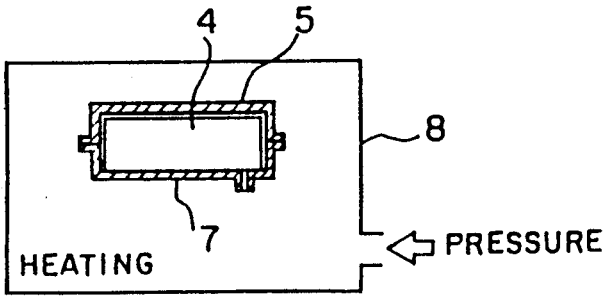

The compact (4) thus obtained is then placed into a stainless steel vessel (5), as for instance shown in FIG. 2C, and a lid (7) equipped with a pipe (6) is welded to the vessel (5). The vessel is evacuated to a vacuum through the pipe, which is then sealed off (FIG. 2D) to maintain the vacuum. The vessel is heated in a furnace (8) while being pressurized by the pressure of the atmosphere surrounding the vessel (FIG. 2E). The heating temperature is below the melting point of Cu (1083° C.), preferably in the range of 800 to 980° C., as in the above-mentioned first embodiment. The pressure of the atmosphere surrounding the vessel is preferably 100 to 2000 atm, and is preferably maintained for 30 minutes to 1 hour. The external atmospheric pressure may be provided by use of Ar, for example.

The atmosphere inside the vessel is preferably a non-oxidizing atmosphere, in order to prevent the oxidation of the powder in the vessel. Though the non-oxidizing atmosphere may be Ar, $N_2$ or the like, such a gaseous atmosphere needs to be introduced after the vessel is once evacuated. Therefore, the atmosphere in the vessel is preferably a vacuum, from the viewpoint of a shorter time required for the intended manufacture and minimization of the pressure of the external atmosphere surrounding the vessel.

Besides, at normal temperature the compact (4) is accompanied by gases and moisture adsorbed on the surfaces of the powder particles, so that sealing the compact (4), as it is, in the stainless steel vessel (5) necessitates long-time evacuation of the vessel. In this consideration, the compact may be used after being sintered at a temperature of 980° C. or below in a non-oxidizing atmosphere to cause desorption of the moisture and the like therefrom. In that case, the non-oxidizing atmosphere may be, for instance, a hydrogen or other reducing atmosphere, an Ar, $N_2$ or other inert gas atmosphere, or a vacuum of about $10^{-3}$ to $10^{-5}$ Torr. Among these non-oxidizing atmospheres, preferred are hydrogen atmospheres and vacuum, from the viewpoint of desorption of moisture and prevention of oxidation.

The contact material and the process for manufacturing the same according to this invention will now be described more in detail, based on the following nonlimitative examples.

EXAMPLES 1–9 and REFERENCE EXAMPLES 1–3

A Cu powder (particle diameter: 10 μm or below; purity: 99.5% or above), a Cr powder (particle diameter: 74 μm or below; purity: 99.5% or above) and a Ti powder (particle diameter: 44 μm or below; purity: 99.9% or above) were weighed and were mixed by a ball mill, in the ratios set forth in Table 1. Each of the thus obtained mixtures was packed into a carbon die (1) as shown in FIG. 1B, was maintained in a vacuum at a temperature of 980° C. and was pressed for 1 hour under a load of 200 kg/cm$^2$, to obtain a contact material.

Besides, though not shown in Table 1, contact materials with respective Cr contents of 30, 40 and 80% by volume were also prepared similarly.

TABLE 1

| | RUN No. | Cu (vol %) | Cr (vol %) | Ti (vol %) |
|---|---|---|---|---|
| EXAMPLE 1 | 1 | 49.5 | 50.0 | 0.5 |
| | 2 | 39.5 | 60.0 | 0.5 |
| | 3 | 29.5 | 70.0 | 0.5 |
| EXAMPLE 2 | 4 | 49.9 | 50.0 | 0.1 |
| | 5 | 39.9 | 60.0 | 0.1 |
| | 6 | 29.9 | 70.0 | 0.1 |
| EXAMPLE 3 | 7 | 49.0 | 50.0 | 1.0 |
| | 8 | 39.0 | 60.0 | 1.0 |
| | 9 | 29.0 | 70.0 | 1.0 |
| REFERENCE EXAMPLE 1 | 10 | 48.5 | 50.0 | 1.5 |
| | 11 | 38.5 | 60.0 | 1.5 |
| | 12 | 28.5 | 70.0 | 1.5 |
| REFERENCE EXAMPLE 2 | 13 | 49.95 | 50.0 | 0.05 |
| | 14 | 39.95 | 60.0 | 0.05 |
| | 15 | 29.95 | 70.0 | 0.05 |
| REFERENCE EXAMPLE 3 | 16 | 49.97 | 50.0 | 0.03 |
| | 17 | 39.97 | 60.0 | 0.03 |
| | 18 | 29.97 | 70.0 | 0.03 |

REFERENCE EXAMPLE 4

By use of the same raw material powders as above, mixed powders having the compositions as set forth in Table 2 were also treated by the same process as above, to obtain contact materials.

Besides, though not shown in Table 2, contact materials with respective Cr contents of 30, 40 and 80% by volume were also prepared similarly.

TABLE 2

| | RUN No. | Cu (vol %) | Cr (vol %) |
|---|---|---|---|
| REFERENCE EXAMPLE 4 | 19 | 50 | 50 |
| | 20 | 40 | 60 |
| | 21 | 30 | 70 |

REFERENCE EXAMPLE 5

By use of the same raw material powders as above, contact materials having the compositions as set forth in Table 3 were produced by the conventional sintering process.

TABLE 3

| | RUN No. | Cu (vol %) | Cr (vol %) |
|---|---|---|---|
| REFERENCE EXAMPLE 5 | 22 | 50 | 50 |
| | 23 | 40 | 60 |
| | 24 | 30 | 70 |

REFERENCE EXAMPLE 6

By use of the conventional infiltration process, Cu-W contact materials as set forth in Table 4 were prepared.

TABLE 4

| | RUN No. | Cu (vol %) | W (vol %) |
|---|---|---|---|
| REFERENCE EXAMPLE 6 | 25 | 50 | 50 |
| | 26 | 40 | 60 |
| | 27 | 30 | 70 |

Figure 3:
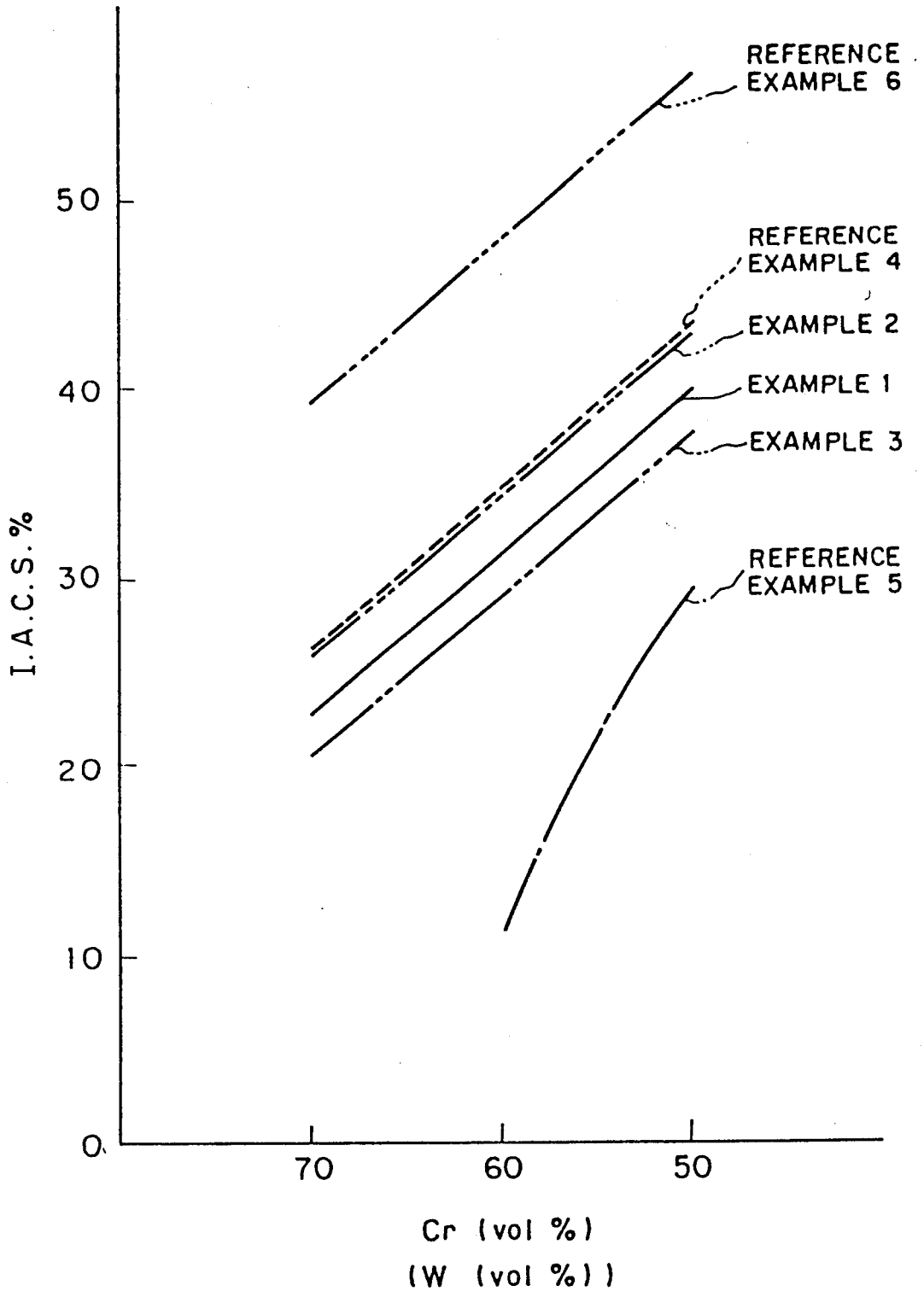
FIG. 3 is a graph showing the electric conductivity of contact materials of this invention and conventional contact materials.
Figure 4:
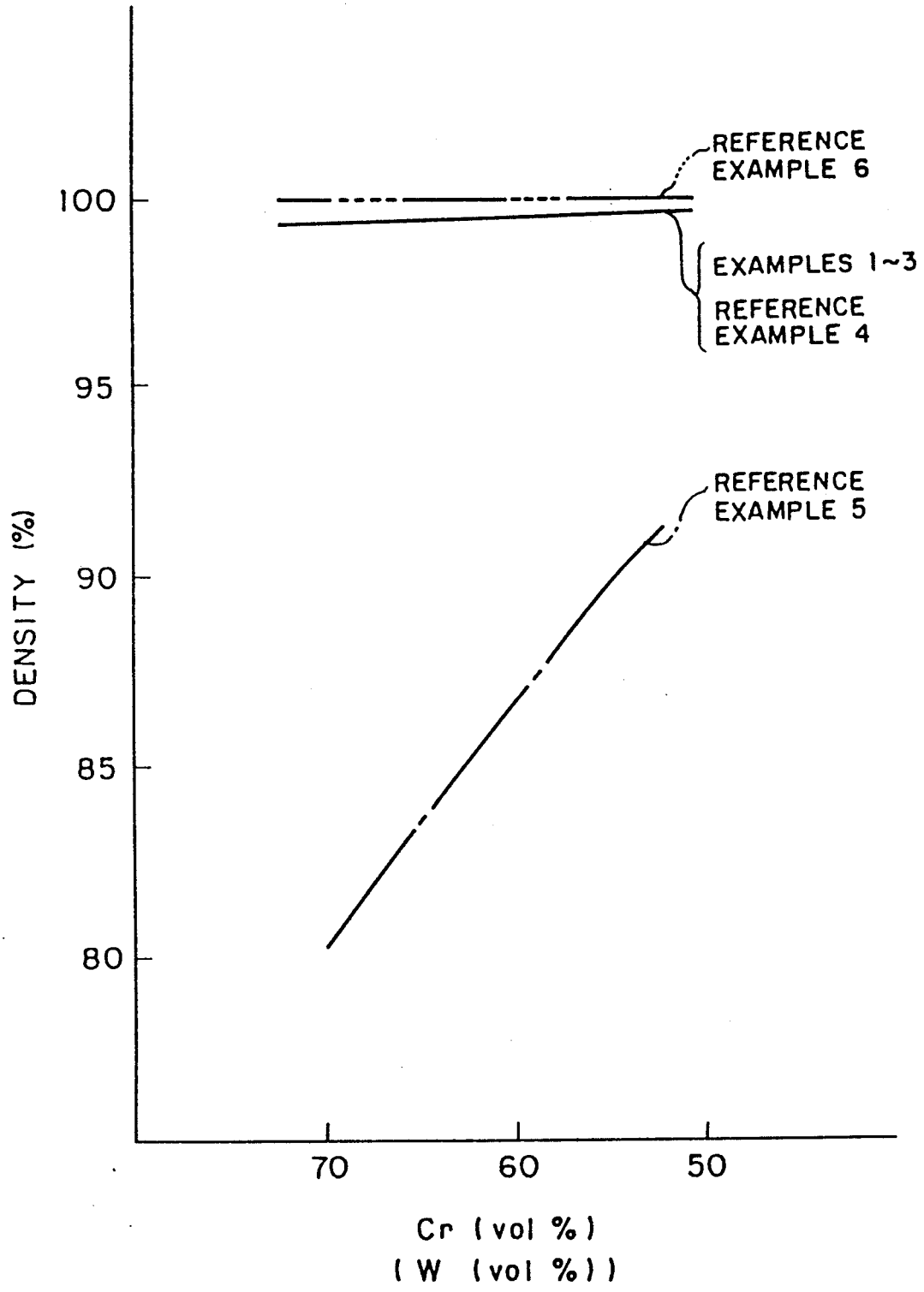
FIG. 4 is a graph showing the density of the contact materials of this invention and the conventional contact materials referenced in FIG. 3.

Each of the contact materials obtained as above were machined into the shape of a circular disk, of which the weight and dimensions were measured to calculate the density. The electric conductivity of each contact material was also measured, by a conductivity meter. The results are shown in FIGS. 3 and 4, respectively.

Each of the circular disks were machined further into the shape of electrodes. The electrodes obtained were mounted in a vacuum switch tube, which was fitted to an operating mechanism, and tests of electrical performances such as withstand voltage performance, circuit breaking (current cutoff) performance, etc., were carried out. The test results are shown in FIGS. 5 to 9.

Figure 10:
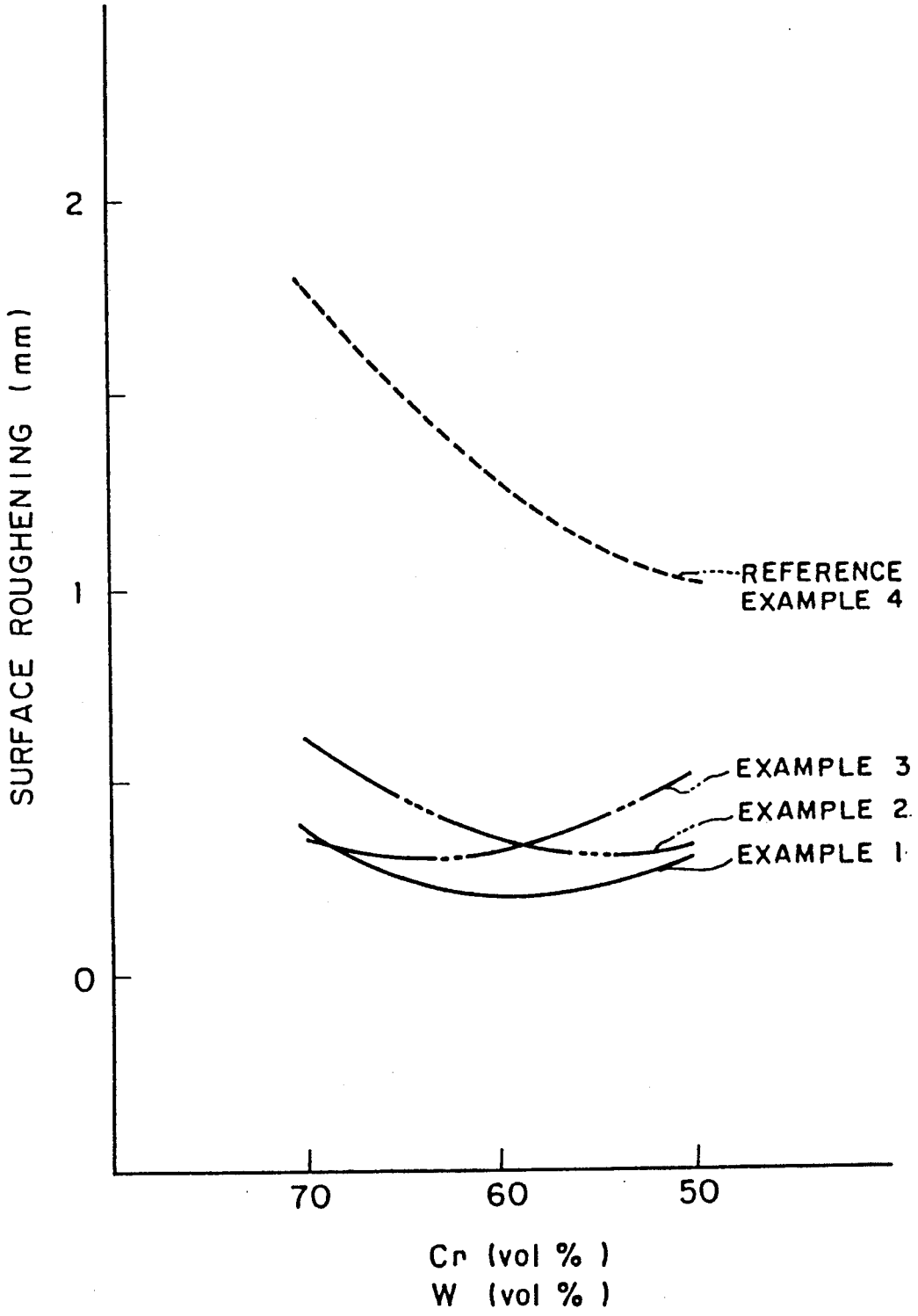
FIG. 10 is a graph showing the relationship between Cr or W content and surface roughening, for the contact materials according to Examples and Reference Examples.

After the electrical performance tests were finished, each vacuum switch tube was disassembled, and the roughening (roughness) of the contact surfaces was measured. The results are shown in FIG. 10.

EXAMPLES 4–6

The same raw material powders as used in Examples 1 to 3 were weighed and were mixed by a ball mill, in the ratios as set forth in Table 5. Each of the mixtures thus obtained was packed into a die and pressed to produce a compact (4). Following the procedure shown in FIGS. 2, the compact (4) was set in a stainless steel can (5), to which a lid (7) was welded, and the vessel was evacuated through an evacuation pipe (6) preliminarily fitted to the stainless steel can (5). The evacuation was carried out by use of an oil diffusion pump, with the stainless steel vessel (5) being heated to about 200 to 400° C. so as to eliminate moisture. After the evacuation was over, the evacuation pipe was pressure welded, and the tip of the pipe was sealed off by a burner. The vessel in this condition was set in an HIP device, and was treated for 1 hour under the conditions of 980° C. and 200 atm.

TABLE 5

| | RUN No. | Cu (vol %) | Cr (vol %) | Ti (vol %) |
|---|---|---|---|---|
| EXAMPLE 4 | 28 | 49.5 | 50.0 | 0.5 |
| | 29 | 39.5 | 60.0 | 0.5 |
| | 30 | 29.5 | 70.0 | 0.5 |
| EXAMPLE 5 | 31 | 49.9 | 50.0 | 0.1 |
| | 32 | 39.9 | 60.0 | 0.1 |
| | 33 | 29.9 | 70.0 | 0.1 |
| EXAMPLE 6 | 31 | 49.0 | 50.0 | 1.0 |
| | 32 | 39.0 | 60.0 | 1.0 |
| | 33 | 29.0 | 70.0 | 1.0 |

Each of the contact materials thus obtained was machined into the shape of a circular disk, of which the weight and dimensions were measured to calculate the density. The electric conductivity of each contact material was also measured by a conductivity meter. The measurement results were the same as those for the contact materials of Examples 1–3 set forth in Table 1. Therefore, the results obtained with Examples 4–6 of the process described just above can be seen, by taking the results of Examples 1–3 in FIGS. 3 and 4 as the results of Examples 4–6, respectively.

Each of the circular disks obtained was mounted in a vacuum switch tube following the same procedure as used for Examples 1–3 above, and the same electrical performance tests as above were carried out. The test results were quite the same as those obtained in Examples 1–3, and can be seen by taking the results of Examples 1–3 in FIGS. 5 to 7 as the results of Examples 4–6, respectively.

The measurement of roughening (roughness) of the contact surfaces after the electrical performance tests was also carried out in the same procedure as used for Examples 1–3. The measurement results were the same as those obtained in Examples 1–3.

From the above, it is seen that the contact material of this invention exhibits the same performance characteristics, regardless of whether the contact material is manufactured by one of the processes according to this invention or by the other of the processes.

In a further embodiment, the mixed powder for use in the hot pressing process illustrated by Examples 1–3 may be preliminarily molded into a compact by a die press, a rubber press or the like. In that case, a higher efficiency is ensured, because the amount of the mixed powder capable of being packed in the die is several times the amount of the mixed powder packable in the die without preliminary molding.

In yet another embodiment, the compact for use in the HIP process illustrated by Examples 4–6 may be preliminarily sintered at a temperature of 600 to 980° C. In that case, the moisture, gases and the like adsorbed on the surfaces of the powder particles are eliminated from the surfaces, and sintering proceeds a little, so that the volume reduction in the HIP process will be smaller, and breakage of the stainless steel vessel or the like accidents can be avoided.

The results shown in FIGS. 3 to 10 will now be discussed.

FIG. 3 is a graph showing the electric conductivity of the contact materials according to this invention. For the Cr-W contact material of Reference Example 6, the axis of abscissa in FIG. 3 represents W content (vol %) instead of Cr content. It is seen from FIG. 3 that the contact materials of this invention are higher in electric conductivity than the Cu-Cr contact material (Reference Example 5) produced by the conventional sintering method. Referring to the results of Reference Example 5 in FIG. 3, the electric conductivity decreases to an extremely low level with increasing Cr content. This marked decrease in the conductivity is attributable to the fact that, in the conventional sintering method, an increase in the Cr content makes the progress of sintering more difficult, resulting in formation of more voids in the material sintered. Besides, due to the nature of the measuring instrument used, it was difficult to measure conductivities, in I.A.C.S. %, of 10% of or below, and the measurement gave no definite conductivity value for the specimen with a Cr content of 70% by volume. The contact materials of this invention had electric conductivities slightly lower than that of the Cu-Cr contact material produced by the hot pressing process in Reference Example 4; as shown, electric conductivity gradually decreases with an increase in Ti content, from 0 vol % (Reference Example 4) through Example 2 (Ti: 0.1 vol %) to Example 3 (Ti: 1 vol %). This tendency is due to the lowering in the electric conductivity of Cu in the contact material caused by the dissolution of Ti in Cu. On the other hand, the Cu-W contact material of Reference Example 6 showed a high electric conductivity. One reason is that Cu and W do not react with each other and, therefore, the conductivity of Cu is not lowered due to the presence of W. Another reason for the high conductivity is that the conventional infiltration method used for the Cu-W contact material of Reference Example 6 ensures substantial absence of voids in the contact material and also such a Cu distribution as to form favorable current paths, with less resistance.

FIG. 4 is a graph showing the density of the contact materials according to this invention. The axis of abscissa represents the Cr content in % by volume, as in FIG. 3 (for Reference Example 6, the W content in % by volume is represented). It is seen from FIG. 4 that the contact materials of this invention (Examples 1–13) have higher densities, as compared with the conventional Cu-C4 contact material of Reference Example 5, and the higher densities (99% or above) are approximate to the theoretical value. The considerably low density of the conventional contact material of Reference Example 5 is due to the hindrance of the progress of sintering, as has been mentioned above. The Cu-Cr contact material of Reference Example 4 gave substantially the same data as the contact materials of this invention, probably because the use of the same production process. On the other hand, the conventional Cu-W contact material of Reference Example 6 showed a conductivity approximately equal to the theoretical value (100%). This is because the use of the infiltration method, in which molten Cu is infiltrated into pores or gaps in a compact of W powder, makes it possible to obtain a nonporous contact material comparatively easily.

Figure 5A:
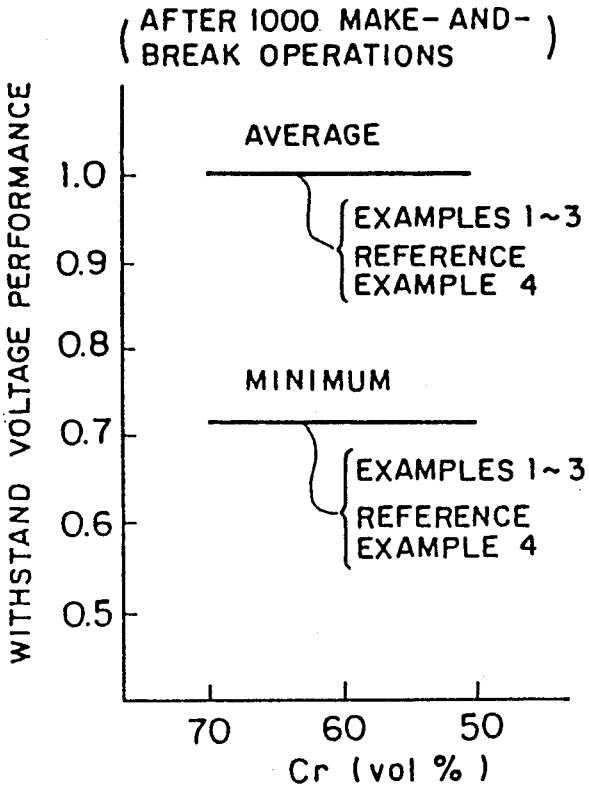
FIGS. 5A–5D are graphs showing the withstand voltage performance of the contact materials of this invention and the conventional contact materials referenced in FIG. 3.
Figure 5B:
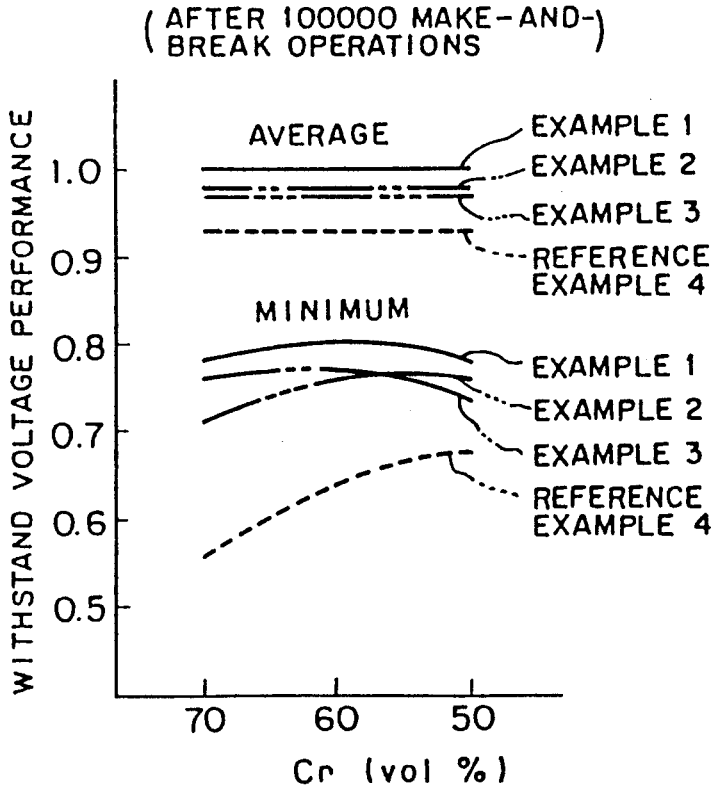
Figure 5C:
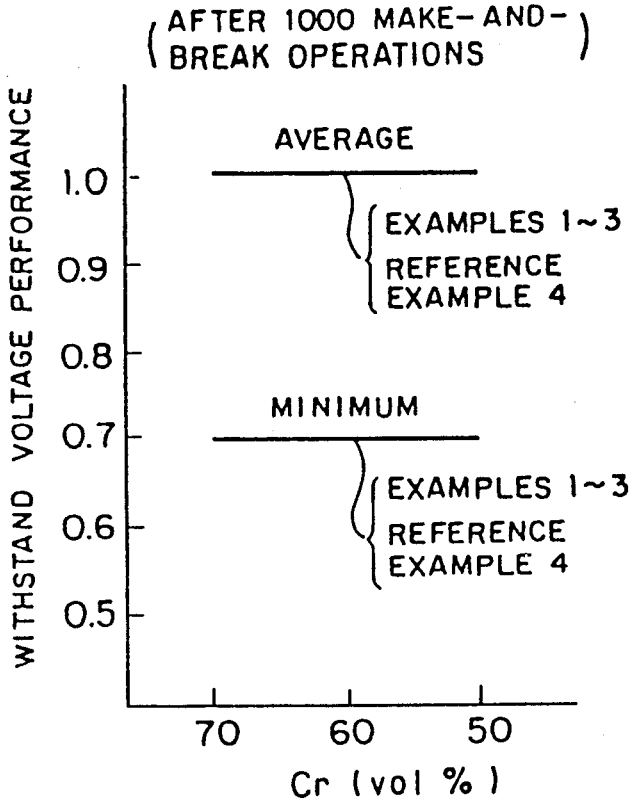
Figure 5D:
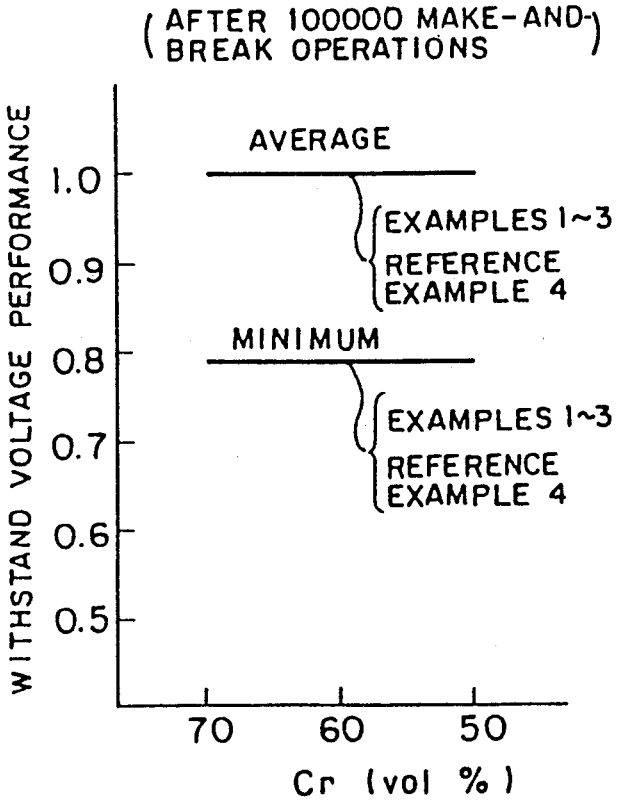

Then, each of the contact materials obtained as above was machined and mounted in a vacuum switch tube, and withstand voltage tests were carried out. The results are shown in FIGS. 5A–5D. The axis of abscissa represents Cr content in % by volume, as in FIG. 3. FIGS. 5A and 5B each show the withstand voltage performance upon current making and no-load breaking operations (making duty mode), with a making current of 5 kA. FIG. 5A shows the data obtained after 1000 make-and-break operations, as initial value, while FIG. 5B shows the data obtained after 100000 make-and-break operations. In FIGS. 5A and 5B, lines on the upper side indicate average values, and lines on the lower side indicate minimum values. FIGS. 5C and 5D each show the withstand voltage performance upon no-load making and current breaking operations (breaking duty mode), with a breaking current of 1 kA. FIG. 5C shows the data obtained after 1000 make-and-break operations, as initial value, while FIG. 5D shows the data obtained after 100000 make-and-break operations. In FIGS. 5C and 5D, lines on the upper side indicate average values, and lines on the lower side indicate minimum values. The withstand voltage performance data is represented as normalized data based on the initial withstand voltage performance (FIGS. 6A and 6B) of the contacts formed of the Cu-W contact material of Reference Example 6.

FIGS. 6A–6D show the results of the withstand voltage tests, the same as those for the contact materials of this invention shown in FIGS. 5A–5D, on the contacts formed of the conventional Cu-W contact material of Reference Example 6. In each of FIGS. 6A–6D, the axis of abscissa represents W content in % by volume, and the line on the upper side indicates average value, while the line on the lower side indicates minimum value.

Figure 6A:
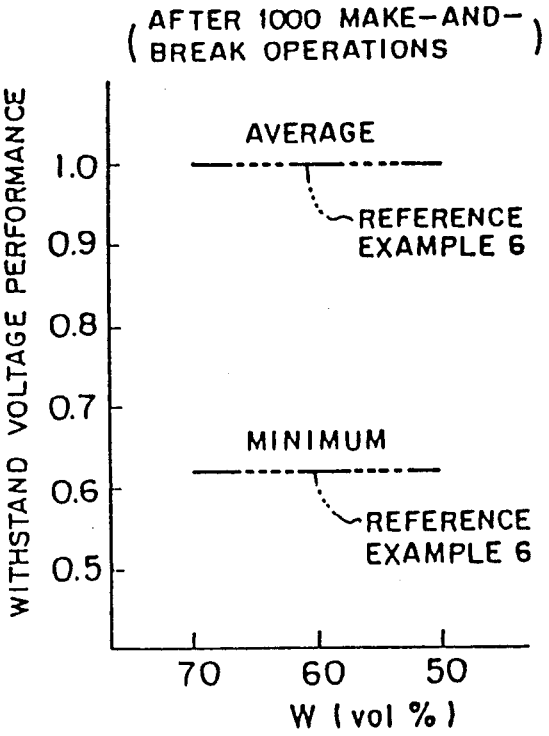
FIGS. 6A–6D are graphs showing the withstand voltage performance of Cu-W contact materials according to the prior art.
Figure 6B:
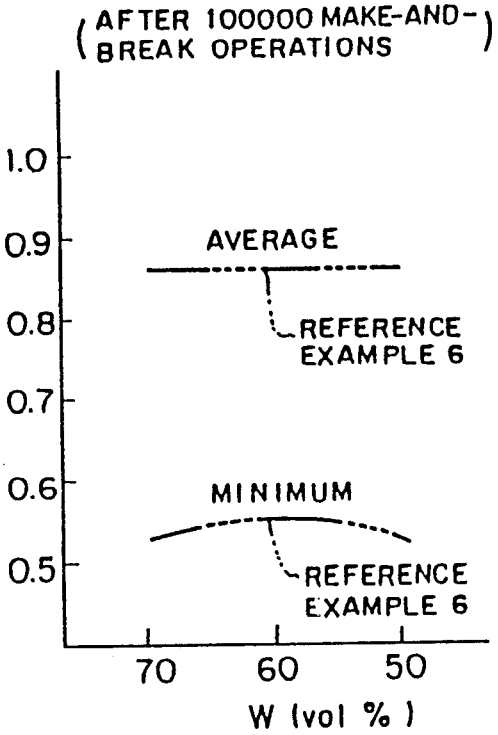

It is seen from FIGS. 6A and 6B that, in the making duty mode, the withstand voltage performance of the contacts made of the Cu-W contact material of Reference Example 6 was lowered from 1.0 to 0.86 in average value, and lowered from 0.62 to a value of 0.53–0.55 in minimum value.

On the other hand, FIGS. 5A and 5B show that, in the making duty mode, the initial withstand voltage performances of the contact materials of this invention in terms of average value are 1.0, the same level as that of the Cu-W contact material of Reference Example 6, and the performances in terms of minimum value are 0.72, which is higher than the corresponding value of 0.62 for the Reference Example 6. After 100000 make-and-break operations, the contacts made of the contact material with a Ti content of 0.5% by volume of Example 1 maintain the initial value of 1.0, whereas the contacts with a Ti content of 0.1% by volume of Example 2 have a withstand voltage performance of 0.97 and the contacts with a Ti content of 1% by volume have 0.98. The values 0.97 and 0.98 of Examples 2 and 3, though slightly lower than the initial value, indicate a much higher withstand voltage performance as compared with the corresponding value of 0.86 for the conventional Cu-W contact material of Reference Example 6. As for the withstand voltage performance in minimum value after 100000 make-and-break operations, the contacts with a Ti content of 0.5% by volume of Example 1 have a value of 0.78–0.8, while the contacts with a Ti content of 0.1% by volume of Example 2 have a value of 0.72–0.76, and the contacts with a Ti content of 1% by volume of Example 3 have a value of 0.74–0.77. All these minimum values, enhanced from the initial minimum value of 0.72 in FIG. 5A, are higher than the initial value of 0.62 for the conventional Cu-W contact material of Reference Example 6, and more conspicuously higher than the corresponding value (after 100000 make-and-break operations) of 0.53–0.55 for the Reference Example 6, thus indicating the superior withstand voltage performance of the contact materials of this invention. The contacts made of the Cu-Cr contact material of Reference Example 4 have an initial average value of 1.0 and an initial minimum value of 0.72, both being equivalent respectively to the corresponding values for the contact materials of this invention. After 100000 make-and-break operations, however, the Cu-Cr contact material of Reference Example 4 has a lowered average value of 0.93 and a lowered minimum value of 0.55–0.68, indicating a deterioration in minimum value from the initial value, though yet superior to the conventional Cu-W contact material of Reference Example 6.

It is seen from FIG. 5B that the effect of Ti addition on the withstand voltage performance of the contact materials of this invention is greatest at a Ti content of 0.5% by volume, for both average value and minimum value of the performance. It is further seen that the highest-value point of the minimum-value data is shifted toward the higher-Cr-content side as the Ti content is increased.

Figure 6C:
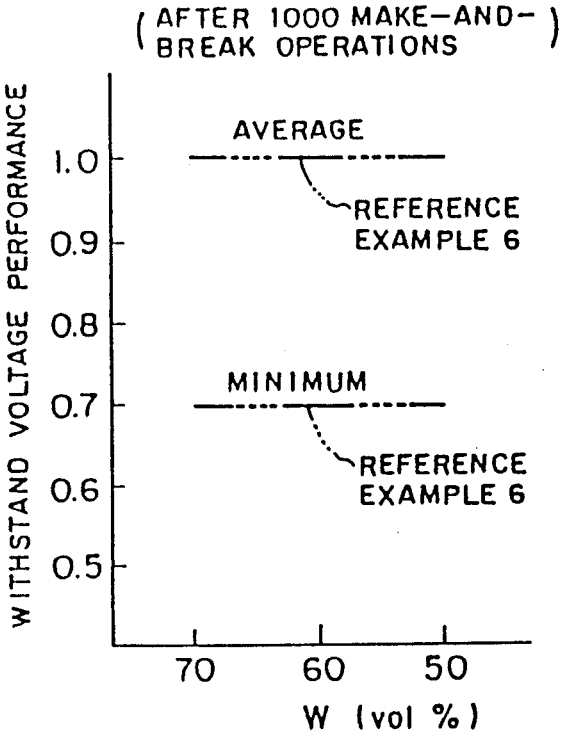
Figure 6D:
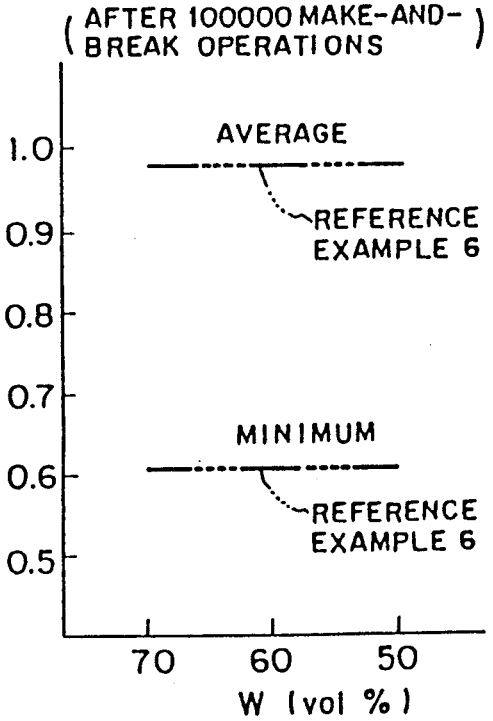

FIGS. 6C and 6D show the breaking duty test results of the contacts made of the Cu-W contact material of Reference Example 6. It is seen from the figures that the withstand voltage performance is lowered from 1.0 to 0.98 in average value, and from 0.7 to 0.61 in minimum value.

On the other hand, FIGS. 5C and 5D show the breaking duty test results of the contacts made of the contact materials of this invention. It is seen from the figures that the initial withstand voltage performances are 1.0 in average value and 0.7 in minimum value, both values being equivalent respectively to the corresponding values for the Cu-W contact material of Reference Example 6. After 100000 make-and-break operations, the average values for the contact materials of this invention remain at the initial value of 1.0, superior to the corresponding value of 0.98 for Reference Example 6, and the minimum values of 0.79 are higher than the initial value of 0.7, indicating the excellent withstand voltage performance of the contact materials of this invention. The contact material of Reference Example 4 also shows the same performance as that of the contact materials of this invention, which indicates that the effect of Ti addition on the withstand voltage performance is particularly distinguished in relation to the making duty mode.

Figure 7A:
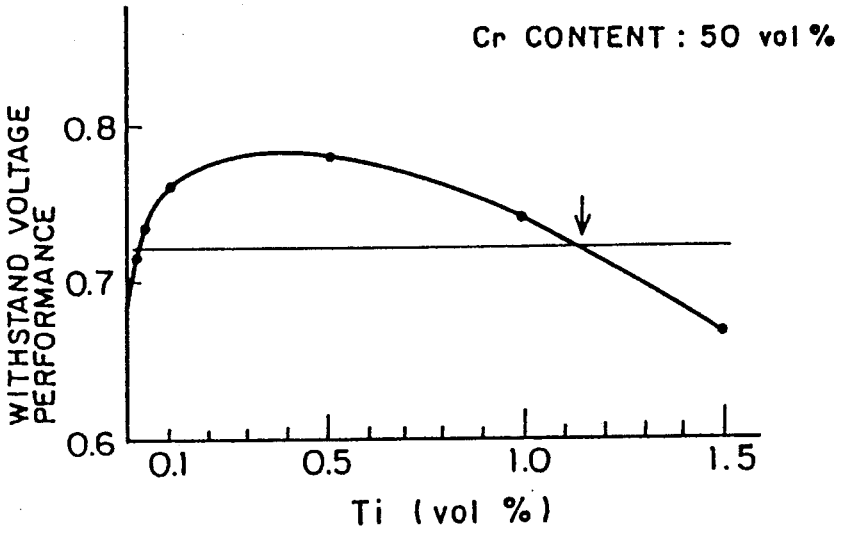
FIGS. 7A–7C are graphs showing the effect of Ti content on withstand voltage performance, for the contact materials of this invention.
Figure 7B:
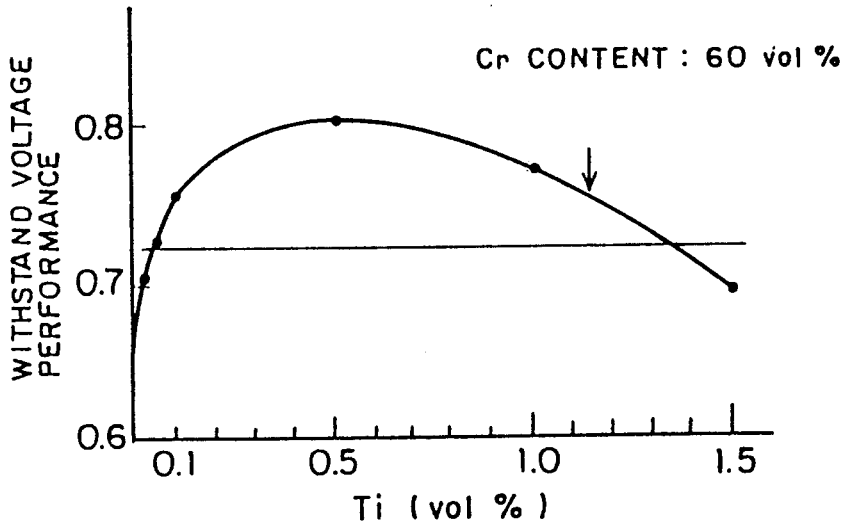
Figure 7C:
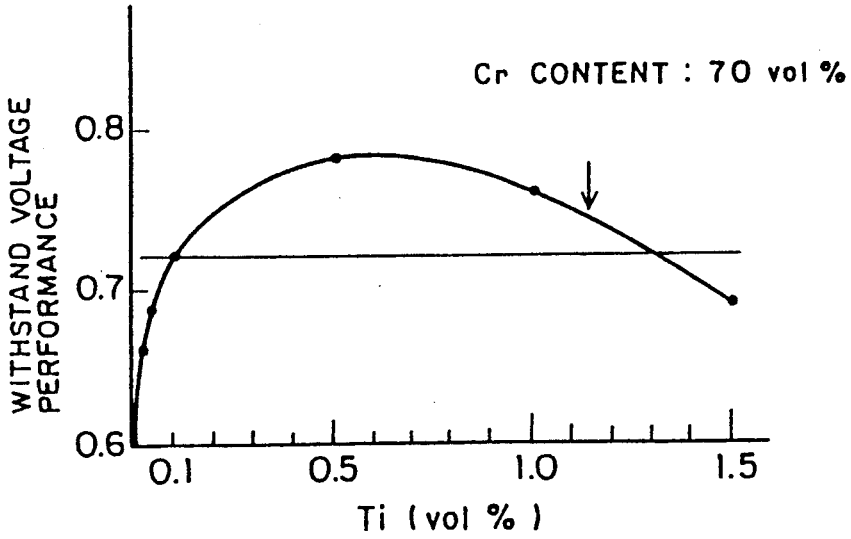

FIGS. 7A–7C illustrate plainly the effect of Ti, in which the axis of abscissa represents the amount of Ti added and the axis of ordinate represents the withstand voltage performance. FIGS. 7A, 7B and 7C correspond to Cr contents of 50, 60 and 70% by volume, respectively. Data falling outside the Ti content range of 0.1 to 1.0% by volume was supplied from the measurement results on switches made of the contact materials of Reference Examples 1–3. Of the withstand voltage performance data, the minimum values are most important because a dielectric breakdown would lead to a serious accident. In this consideration, FIGS. 7A–7C show plots of minimum values of withstand voltage performance after 100000 operations in the making duty mode. FIG. 7A shows that, with a Cr content of 50% by volume, the withstand voltage performance is higher than the initial value of 0.72 when the Ti content is in the range of 0.04 to 1.15% by volume. FIG. 5B shows that with a Cr content of 60% by volume, the performance is higher than the initial value of 0.72 when the Ti content is in the range of 0.05 to 1.35% by volume. FIG. 5C shows that with a Cr content of 70% by volume, the performance is higher than the initial value when the Ti content is in the range of 0.1 to 1.3% by volume. Thus, with the Cr contents of 50, 60 and 70% by volume, excellent withstand voltage performance is obtained in the respective Ti content ranges as mentioned above.

It is important for the withstand voltage performance not to be lowered with an increase in the number of make-and-break operations of the switch, from the viewpoints of retention of switch quality as well as inspection and maintenance.

Figure 8:
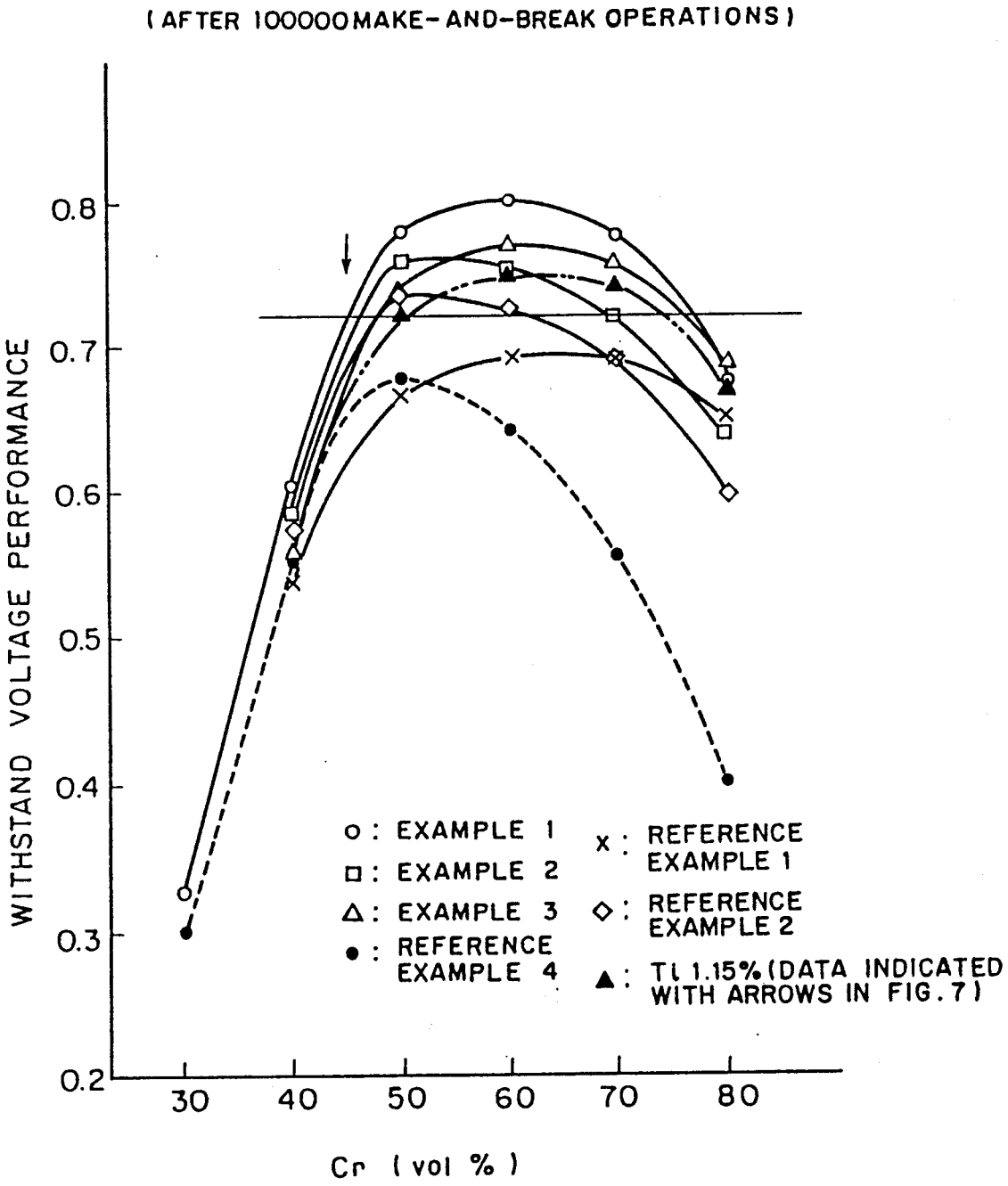
FIG. 8 is a graph showing the effect of Cr content on withstand voltage performance, for the contact materials of this invention.

FIG. 8 illustrates the effect of Ti addition and the effects of Cr content on withstand voltage performance. The switches using the conventional Cu-Cr material without Ti addition, of Reference Example 4, have a peak of withstand voltage performance at a Cr content of about 50% by volume, but the peak value is only about 0.68, which is lower than the initial value of 0.72. It is also seen that the withstand voltage performance tends to be enhanced as the Ti addition amount increases to about 0.5% by volume, and the performance is lowered as the Ti addition amount exceeds 0.5% by volume. Where the Ti content is 0.5% by volume, the lower limit of the Cr content for maintaining the initial performance value of 0.72 is 45% by volume and the upper limit is 73% by volume.

It is understood from the average-value and minimum-value data of withstand voltage performance as set forth above that the contact materials according to this invention, even after 100000 make-and-break operations of switch, exhibit superior performance as compared to the conventional Cu-W contact material, both in the making duty mode and in the breaking duty mode. In practical use, not only the average value of performance but the minimum value relevant to the actual occurrence of dielectric breakdown is important. From this point of view, the Cu-Cr contact material of Reference Example 4 (Refer to FIG. 5B) is found to be very hard to use, because of the lowering in the minimum value of performance as compared with the initial value thereof.

Data on the Cu-Cr contact material prepared by the sintering method, as an example of the prior art, is not shown in the figures because the withstand voltage performance of the material was very low, from the beginning.

Figure 9:
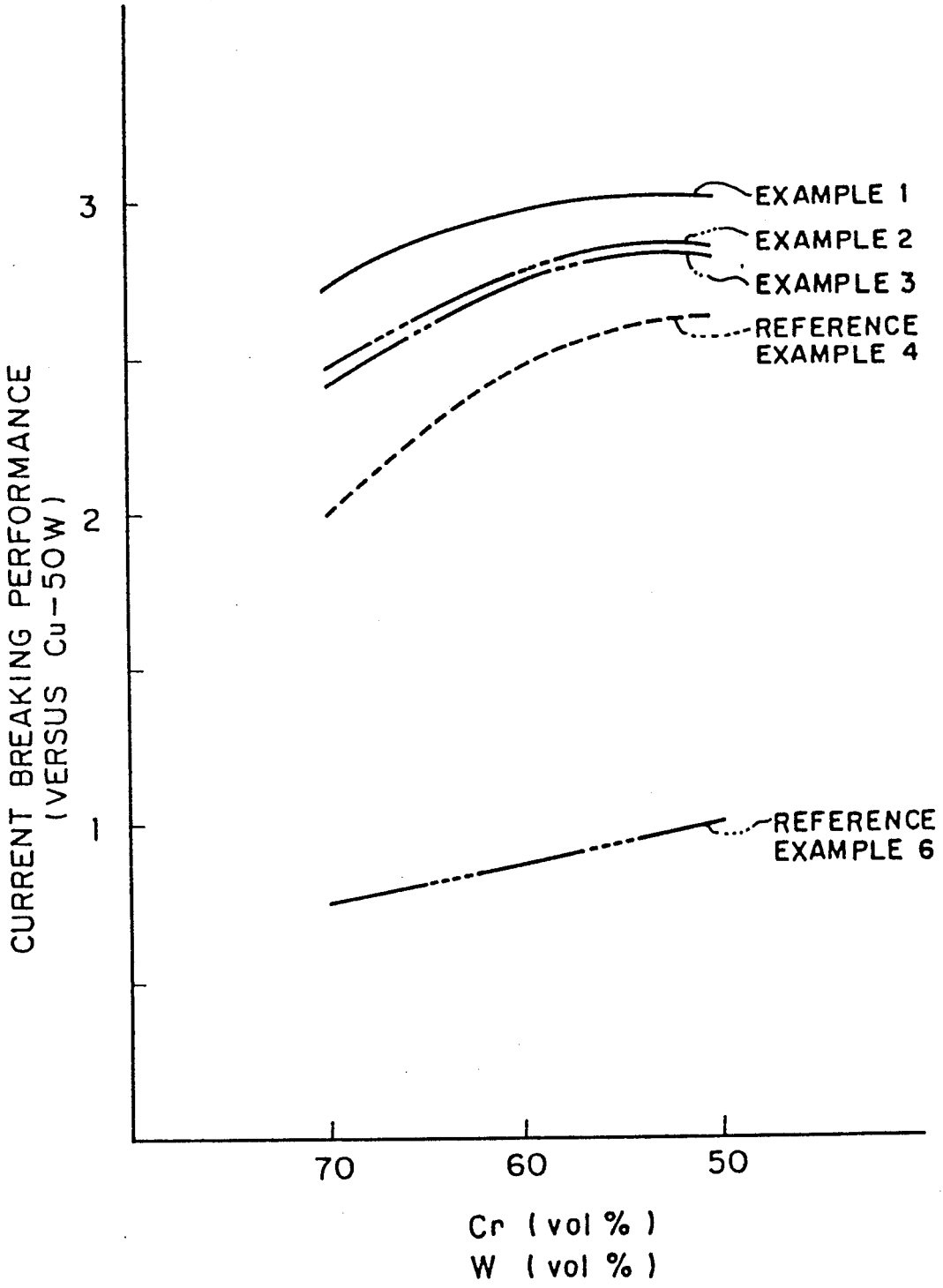
FIG. 9 is a graph showing the relationship between Cr or W content and circuit breaking performance, for contact materials according to Examples and Reference Examples.

FIG. 9 shows the current breaking performance of switches using the contact material of this invention, with the axis of abscissa representing Cr content in % by volume. In FIG. 9, the breaking performance of a switch using the contact material of Reference Example 4 and the breaking performance of a switch using the Cu-W contact material of Reference Example 6 are also shown, with W content in % by volume. The current breaking performance of each switch is represented by taking the current breaking performance relevant to a Cu-50 vol % W contact material as a reference. Single-phase synthesis breaking tests were carried out, with a current gradually increased, and the maximum current value at which a switch showed a successful breaking action was adopted as the breaking performance of the switch. FIG. 9 shows that the switches using the contact material of this invention are by far superior in current breaking performance to the switches using the conventional Cu-W contact material of Reference Example 6, and are superior to the switches using the Cu-Cr contact material of Reference Example 4. As for the effect of Ti addition, an addition amount of 0.1% by volume (Example 2) gave a performance higher than the performance of the Cu-Cr material of Reference Example 4, an addition amount of 0.5% by volume (Example 1) gave the best performance, and an addition amount of 1% by volume (Example 3) gave a performance which is slightly lower as compared to the above two cases but is yet higher as compared to Reference Example 4. There is seen a general tendency that the current breaking performance decreases with increasing Cr content, presumably because the corresponding decrease in the Cu content of the contact material causes a lowering in the electric conductivity, namely, a rise in the resistance of the material, leading to an increase in the Joule heat generated at the time of cutting off a current, and the poor thermal conductivity hinders favorable diffusion of the thermal energy arising from an arc.

FIG. 10 shows the surface roughening (or roughness) of contacts, examined upon disassembly of the vacuum switch tubes having been subjected to 100000 make-and-break operations in the above-mentioned withstand voltage test (making duty mode). In the figure, the axis of abscissa represents Cr content in % by volume. The axis of ordinate represents the surface roughness namely, the maximum value (in mm) of recesses or projections of the contact surface after the test, measured from a reference surface constituted of the contact surface before the mounting of the contacts in the vacuum switch tube. It is seen from FIG. 8 that the switches using the contact material of this invention show less surface roughening, after 100000 operations in the making duty mode, as compared with the switches using the contact material of Reference Example 4. This fact indicates the excellency of the contact material of this invention, and also indicates that the surface roughening has an important effect on the above-mentioned withstand voltage performance.

The switches using the conventional Cu-W contact material of Reference Example 6 showed heavy roughening of contact surface, namely, 5 mm or more.

The surface roughening is formed in the following manner. When a closing current of the switch makes the contacts join to each other in the state of being minutely melted by a closing arc, and, when the joined portions are tripped, a phenomenon (called "transfer") occurs where a surface portion of one of the contacts is transferred to the other contact. With the phenomenon repeated a large number of times, the transfer builds up gradually. The reason for the slight surface roughening of the contact material of this invention is considered to be that a comparatively brittle structure containing Ti is formed at the minutely melted portions, and tripping of the contacts occurs at the comparatively brittle structure, thereby suppressing the build-up of transfer.

As a result, the contacts showing less surface roughening were better in withstand voltage performance after 100000 make-and-break operations. In practice, however, a protrusion present on a contact surface causes concentration of electric field on that portion, thereby lowering the voltage necessary for dielectric breakdown. Therefore, it can be said that the less the surface roughening of contact, the higher the stability of the contacts on a withstand voltage basis.

On the other hand, the switches subjected to the withstand voltage tests in the breaking duty mode showed little surface roughening. The reason is as follows. Because the current is cut off after the contacts are brought into contact with each other under no load, the contacts are not fused to each other, and the contact surfaces are sweeped by arcs, so that the contact surfaces are maintained in a comparatively flat condition. Meanwhile, the switches using the conventional Cu-W contact material of Reference Example 6 showed a lowering in the withstand voltage performance, as mentioned above. It seems that the large difference in melting point between Cu and W caused selective evaporation and dispersion of Cu by current arcs, rendering the contact surface layers rich in W, and the presence of some ruggedness of the contact surfaces facilitated the emission of electrons.

From the above-mentioned results, it is seen that when the contact material of this invention comprises 50 to 70% by volume of Cr, 0.1 to 1.15% by volume of Ti and the remainder of Cu and has an electric conductivity, $$-0.85 \times (\text{vol \% of Cr}) + 6.1 \times (\text{vol \% of Ti}) + 78.9 \leqq \text{I.A.C.S. \%}$$

$$-0.85 \times (\text{vol \% of Cr}) + 85.5 > \text{I.A.C.S. \%}$$

and a density of at least 99%, the contact material shows excellent withstand voltage performance, even after 100000 make-and-brake operations in both a making duty mode and a breaking duty mode, together with extremely little roughening of contact surfaces as well as excellent current breaking performance.

Furthermore, the contact material of this invention can be manufactured advantageously minimizing the reaction between Cu and Cr, to thereby restrain a lowering in electric conductivity, and ensuring a high density, according to the process of this invention.

Besides, when the contact material of this invention was mounted in a vacuum switch tube in the above-mentioned manner and a test of making and breaking a load of 1 kA was repeated 100000 times, the withstand voltage performance was not lowered, and elongation of a breaking arc was not observed even upon the 100000th test operation. The elongation of a breaking arc, here, means that due to a lowering in breaking performance, a breaking action can not be completed at the zero point of current in a given AC half-wave but is completed at the zero current point in the second half-wave or at the zero current point in the third half-wave, whereby the arcing time is prolonged. Moreover, incapability of tripping due to welding of the contacts was not observed, and the contact surfaces were very clean.

REFERENCE EXAMPLE 7

A contact material having the same composition as in Run No. 13 of Reference Example 2 was prepared following the same procedure as in Example 1, except that pressing was carried out under a load of 100 kg/cm$^2$. The density and electric conductivity of the contact material thus obtained were measured by the same methods as above-mentioned. The density was 97% and the electric conductivity, in I.A.C.S. %, was 27%. The contact material was mounted in a vacuum switch tube and subjected to electrical performance tests, in the same manner as above-mentioned. As withstand voltage performance in the making duty mode, the contact material showed initially an average of 0.98 and a minimum of 0.98, and after 100000 make-and-break operations, an average of 0.85 and a minimum of 0.6. As withstand voltage performance in the breaking duty mode, the contact material showed initially an average of 1.0 and a minimum of 0.7, and after 100000 make-and-break operations, an average of 1.0 and a minimum of 0.7. Thus, it is seen that the withstand voltage performance is lowered as the density and electric conductivity are lowered. The surface roughness of the contacts after 100000 make-and-break operations in the making duty mode was as large as 3 mm, indicating a heavy influence of density. The current breaking performance of the contact material was little different from that of the contact material of this invention.

REFERENCE EXAMPLE 8

A contact material having the same composition as in Run No. 29 of Example 4 was prepared in the same manner as in Example 4, except that the heating temperature was 1100° C., which is higher than the melting point of copper. The density and electric conductivity of the contact material obtained were measured by the same methods as above-mentioned. The density was 99.9% and the electric conductivity, in I.A.C.S. %, was 25%. The reason for the low electric conductivity, notwithstanding the high density, is that the heating to the temperature (1100° C.) higher than the melting point of copper caused reactions of Cu with Cr and Ti, whereby large amounts of Cr and Ti were dissolved in Cu to lower the electric conductivity of Cu. The contact material was mounted into a vacuum switch tube and subjected to electrical performance tests, in the same manner as mentioned above. As withstand voltage performance in the making duty mode, the contact material showed initially an average of 1.0 and a minimum of 0.71, and after 100000 make-and-break operations, an average of 0.93 and a minimum of 0.7, which was slightly lower than the initial minimum value. The withstand voltage performance in the breaking mode of the contact material was substantially equivalent to that of the contact material of this invention. The surface roughening of contact surfaces was about 2 mm, namely, slightly worse as compared with the contact material of this invention. The breaking performance was little different from that of the contact material of this invention.

From the above-mentioned results of various tests, it will be clearly understood that the contact material comprising Cu, Cr and Ti according to this invention is a contact material for vacuum switch tubes which maintains excellent withstand voltage performance even after a large number of load making operations, load breaking operations or load making and load breaking operations, and has excellent performance characteristics such as circuit breaking performance, contact surface roughening-proof qualities, small tripping force against welding, etc. In addition, the process according to this invention enables advantageous manufacture of a contact material having such excellent characteristics.

What is claimed is:

1. A sintered electric contact material for vacuum switch tubes comprising: 50 to 70% by volume of Cr; 0.1 to 1.15% by volume of Ti; and the residual volume of Cu.

2. The electric contact material as set forth in claim 1, wherein the Ti content is 0.5 to 1.0% by volume.

3. The electric contact material as set forth in claim 1, wherein the Cr content is 50.0 to 70.0% by volume.

4. A process for manufacturing a sintered electric contact material for vacuum switch tubes, comprising the steps of: mixing 50 to 70% by volume of a Cr powder, 0.1 to 1.15% by volume of a Ti powder and the residual volume of a Cu powder; and sintering the resultant mixture by pressing and heating the mixture at a temperature below the melting point of Cu in a non-oxidizing atmosphere.

5. The process as set forth in claim 4, wherein each of the Cr powder, the Ti powder and the Cu powder has an average particle diameter of not more than 100 μm.

6. The process as set forth in claim 4, wherein the mixture is compressed in a die, and the sintering step is carried out while the mixture is in the compressed state.

7. The process as set forth in claim 6, wherein the compression in the die is carried out by relative movements of an opposed pair of punches.

8. The process as set forth in claim 6 or 7, wherein the die is made of carbon.

9. The process as set forth in claim 4, wherein the non-oxidizing atmosphere is formed from a hydrogen, argon or nitrogen gas.

10. The process as set forth in claim 9, wherein the non-oxidizing atmosphere is formed from an argon or nitrogen gas at a pressure of $10^{-3}$ to $10^{-5}$ Torr.

11. The process as set forth in claim 4, wherein the temperature in the sintering step is 800 to 900° C.

12. The process as set forth in claim 4, wherein the pressing is carried out under a pressure of about 200 to 500 kg/cm$^2$.

13. A process for manufacturing a sintered electric contact material for vacuum switch tubes, comprising the steps of: mixing 50 to 70% by volume of a Cr powder, 0.1 to 1.15% by volume of a Ti powder and the residual volume of a Cu powder; preliminarily pressing the thus obtained mixture to mold a compact of a predetermined shape; and sintering the resultant compact by heating at a temperature below the melting point of Cu in a non-oxidizing atmosphere.

14. The process as set forth in claim 13, wherein a content of the Ti powder is 0.5 to 1.0% by volume.

15. The process as set forth in claim 13, wherein a content of the Cr powder is 50.0 to 70.0% by volume.

16. The process as set forth in claim 13, further comprising the steps of: enclosing the compact in a hermetically sealed vessel; and evacuating the vessel, whereby the compact is heated under pressure, together with the vessel.

17. The process as set forth in claim 16, wherein the pressure applied to the compact is 100 to 200 atm.

* * * * *

UNITED STATES PATENT AND TRADEMARK OFFICE

CERTIFICATE OF CORRECTION

PATENT NO. : 5,019,156

DATED : May 28, 1991

INVENTOR(S) : Eizo Naya et al.

It is certified that error appears in the above-identified patent and that said Letters Patent is hereby corrected as shown below:

Column 1, line 40, delete "low" and insert therefor --poor--;
line 47, delete "the" and insert therefor --that--.

Column 2, line 5, before "of" insert --by volume--.

Column 7, line 67, delete "(Examples 1-13)" and insert therefor --(Examples 1-3)--.

Column 8, line 1, delete "Cu-C4" and insert therefor --Cu-Cr--.

Signed and Sealed this

Fourteenth Day of September, 1993

Bruce Lehman

*Attest:*

BRUCE LEHMAN

*Attesting Officer*

*Commissioner of Patents and Trademarks*